US006894467B2

(12) United States Patent
Pons et al.

(10) Patent No.: US 6,894,467 B2
(45) Date of Patent: May 17, 2005

(54) LINEAR VOLTAGE REGULATOR

(75) Inventors: Alexandre Pons, Grenoble (FR); Christophe Bernard, Claix (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/614,380

(22) Filed: Jul. 7, 2003

(65) Prior Publication Data

US 2004/0008015 A1 Jan. 15, 2004

(30) Foreign Application Priority Data

Jul. 9, 2002 (FR) ..... 02 08624

(51) Int. Cl.[7] ..... G05F 1/40
(52) U.S. Cl. ..... 323/273
(58) Field of Search ..... 323/273, 274, 323/275, 280, 281

(56) References Cited

U.S. PATENT DOCUMENTS 6,084,389 A * 7/2000 Gens et al. ..... 323/315
6,104,179 A 8/2000 Yukawa
6,150,798 A * 11/2000 Ferry et al. ..... 323/273
6,429,633 B1 * 8/2002 Kajiwara et al. ..... 323/282
6,664,772 B2 * 12/2003 Saeki et al. ..... 323/273
2001/0007537 A1 7/2001 Agawa et al.

FOREIGN PATENT DOCUMENTS

EP 1 089 154 A1 4/2001

* cited by examiner

*Primary Examiner*—Adolf Berhane
(74) *Attorney, Agent, or Firm*—Lisa K. Jorgenson; James H. Morris; Wolf, Greenfield & Sacks, P.C.

(57) ABSTRACT

A linear regulator having an output stage including first and second P-channel MOS transistors series connected between a first D.C. supply terminal and an output terminal providing a regulated output voltage, and a circuit for controlling the first and second transistors capable of providing the first and second transistors with first and second control signals according to the output voltage and to the voltage at the midpoint of the series connection.

12 Claims, 3 Drawing Sheets

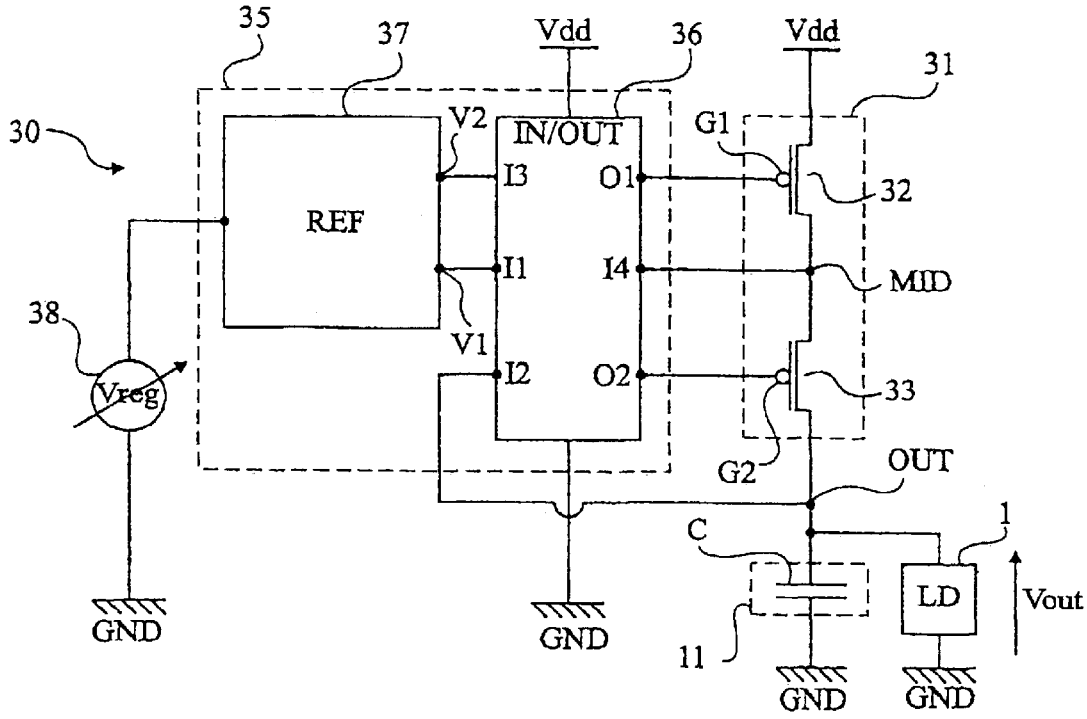
Fig 3
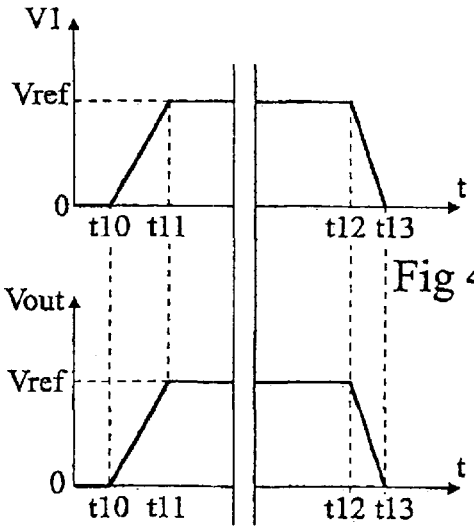
Fig 4A
Fig 4B
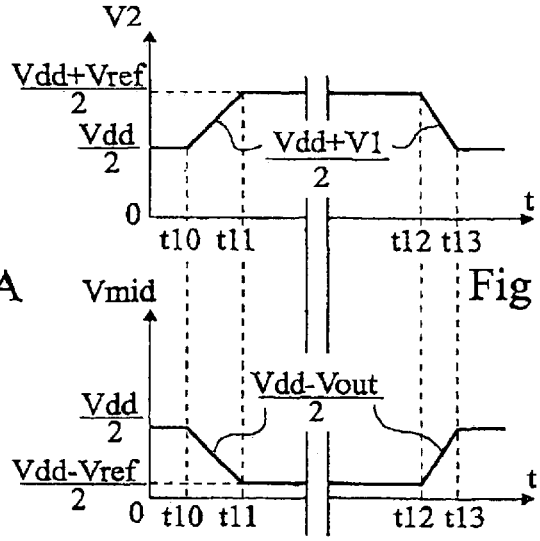
Fig 4C
Fig 4D

LINEAR VOLTAGE REGULATOR

BACKGROUND OF THE INVENTION

1. Field of the Invention

The present invention generally relates to the regulation of a voltage across a load. More specifically, the present invention relates to such a regulation performed in linear fashion.

2. Discussion of the Related Art

FIG. 1 partially and schematically illustrates a conventional example of a linear regulator of a voltage Vout across a load (LD) 1. The regulator comprises a P-channel MOS transistor 2 having its source connected to a high voltage supply rail Vdd and having its drain forming output terminal OUT of the regulator. Load 1 is connected between terminal OUT and a low supply or reference voltage rail or ground GND. Transistor 2 operates in linear state, that is, its transconductance is used to vary its output current according to the control voltage applied on its gate G. The control voltage of gate G is regulated according to voltage Vout across load 1. The regulation is performed by a differential comparator 3 comprising an input/output stage 4 and an output stage 5. Input/output stage 4 comprises two differential branches each comprised of a P-channel MOS transistor 61, 62 series-connected with an N-channel MOS transistor 63, 64. The sources of transistors 61 and 62 are connected to an output terminal of a current source 60, an input terminal of which is connected to high supply Vdd. The sources of transistors 63 and 64 are connected to low supply GND. The gates of transistors 63 and 64 are interconnected. A branch 61-63 forms an input branch, while the other branch 62-64 forms an output branch. Transistor 61 of the input branch receives a D.C. constant voltage reference Vreg provided by a voltage generator 8, connected between the gate of transistor 61 and ground GND. The gate of transistor 63 is connected to its drain, that is, also to the drain of transistor 61. The gate of transistor 63 receives voltage Vout across load 1 by a connection to output terminal OUT of the regulator, possibly to an intermediary tap of a resistor bridge. Connection point 65 of the drains of transistors 62 and 64 forms the output of input/output stage 4 of comparator 3.

Output stage 5 is formed of the series connection, between high supply Vdd and low supply GND, of a generally resistive impedance 9 (R) and an N-channel MOS transistor 10. The connection point of impedance 9 and of transistor 10 forms the output terminal of differential comparator 3 connected to gate G of regulation transistor 2. The gate of transistor 10 is connected to point 65 of differential input/output branch 62-64.

The regulator further comprises a generally capacitive impedance (C) 11, intended to stabilize output voltage Vout.

FIGS. 2A–2C illustrate in timing diagrams an example of the variation along time t of reference voltage Vreg across source 8, of output voltage Vout across load 1, and of voltage Vds between the drain and source terminals of transistor 2. At the circuit power-on, at a time t0, constant D.C. voltage generator 8 is validated to provide a steady non-zero nominal regulation reference voltage Vref until a circuit turn-off time t1. Differential comparator 3 then forces, as illustrated in FIG. 2B, output voltage Vout to follow regulation voltage Vreg and to align on reference level Vref. Voltage Vout is then steadily regulated at level Vref by the gate control until time t1 when the circuit is turned off or set to stand-by. This regulation is performed by a control in linear mode of transistor 2, which is used as a variable transconductance, the output current of which depends on the control voltage of gate G.

Applications in which load 1 must be supplied at a voltage level on the order of from 3.3 to 5.5 volts are more specifically considered in the present invention. Such a value is relatively high as compared to the maximum voltage on the order of from 2.4 to 2.8 volts that the components (in particular MOS transistor 2) used in standard integration technological manufacturing processes can stand. However, in off periods of load 1, MOS transistor 2 must stand voltage Vdd across its terminals.

Indeed, as illustrated in FIG. 2C, in off phases of load 1 (Vreg=0, FIG. 2A), that is, before turn-on time t0 and after turn-off time t1, transistor 2 controlling load 1 must stand, between its drain and source terminals, a potential difference Vds equal to supply amplitude Vdd-GND. However, during the operation of load 1 (Vreg=Vref), voltage Vds is reduced to the difference between high supply Vdd and voltage Vout across load 1, that is, nominal regulation value Vref.

To enable transistor 2 to stand the voltage during off phases, the 2.5-volt standard manufacturing process has been modified to insert MOS transistors capable of withstanding a maximum voltage greater than 5 volts between their drain and their source. The masks of definition of regulation transistor 2 have, in particular, been modified with respect to the neighboring transistors, to considerably increase the thickness of a portion of a gate insulator close to one of the drain/source regions and to increase the surface area of this same drain/source region. But then, the stray capacitance of the gate of transistor 2 is increased, and its transconductance is reduced. Now, to enable linear control of transistor 2 such as previously described with sufficiently low control levels, the transconductance must be relatively high. To increase it, the integration surface area of transistor 2 must then be further increased.

The surface area increase results in sometimes having to integrate the control switches outside of the chip in which the rest of the power circuit forming the voltage regulator is formed. Further, account must then be taken of a relatively high stray capacitance as compared to the stray capacitances of the other circuit components. Further, the waste voltage, that is, the difference between regulation voltage Vref and output voltage Vout may not easily be reduced to less than 500 mV. This is particularly disadvantageous in portable devices such as electronic diaries, satellite telephones, portable computers or pocket organizers. Indeed, obtaining the nominal output level necessary to the proper load operation requires using a reference voltage of higher level. This increases the circuit bulk and/or, more generally, then causes an accelerated discharge of the batteries supplying the entire circuit and enabling provision of reference voltage Vref. In this last case, frequent recharges of the device batteries must be performed, which is incompatible with their portable character.

Further, the modifications of the manufacturing process necessary to form the regulation MOS transistor are particularly impairing in terms of complication of the general process and of cost.

To overcome these problems, it has been provided to use a regulation transistor of high-voltage bipolar type, which has the advantage of requiring less integration surface area than the specific MOS transistor, especially because it can more easily be integrated vertically in a silicon substrate. However, the use of a bipolar transistor poses many problems.

Especially, a BiCMOS manufacturing process which is more complex than the MOS manufacturing process must be used. A specific circuit must also be provided to set the operating point of the bipolar transistor, and especially provide a limitation of the base current. Further, a bipolar regulation transistor results in higher waste voltages than a MOS transistor with a more restricted linearity range. This is particularly disadvantageous in the case of devices of portable type for which it is desirable to reduce the waste voltage as much as possible, that is, to make it, preferably, smaller than 200 mV.

SUMMARY OF THE INVENTION

The present invention aims at providing a linear regulator which overcomes the disadvantages of known circuits.

The present invention in particular aims at providing a linear regulator which exhibits a reduced waste voltage.

The present invention aims at providing such a regulator that can be manufactured by means of a standard MOS manufacturing process.

To achieve these and other objects, the present invention provides a linear regulator comprising an output stage comprised of first and second P-channel MOS transistors series connected between a first D.C. supply terminal and an output terminal providing a regulated output voltage, and a circuit for controlling the first and second transistors capable of providing first and second control signals according to the output voltage and to the voltage at the midpoint of the series connection.

According to an embodiment of the present invention, the control circuit comprises an input/output circuit and a reference circuit, the input/output circuit comprising a first input, receiving a first voltage reference provided by said reference circuit; a second input, connected to said output terminal; a third input receiving a second voltage reference provided by said reference circuit; a fourth input connected to said midpoint; a first output connected to the gate of the first transistor; and a second output connected to the gate of the second transistor.

According to an embodiment of the present invention, the input/output circuit is a double differential comparator with four inputs and two outputs.

According to an embodiment of the present invention, the input/output circuit comprises first and second differential comparators with two inputs and two outputs, the input terminals of the first differential comparator being the first and second input terminals of the input/output circuit and its output being the second output of said input/output circuit; and the input terminals of the second differential comparator being the third and fourth input terminals of said input/output circuit and its output being the first output thereof.

According to an embodiment of the present invention, the first differential comparator comprises an input/output stage and an output stage, said input/output stage comprising two differential branches, each of which comprises a P-channel MOS transistor connected in series with a fist N-channel MOS transistor, the sources of the P-channel transistors being interconnected to an output terminal of a current source having an input terminal connected to said D.C. supply terminal, the sources of the first N-channel transistors being interconnected to a ground terminal, the gates of said first N-channel MOS transistors being interconnected, the gates of the P-channel transistors forming the first and second input terminals of the input/output circuit, the gate of the first N-channel MOS transistor of the branch comprising the first input being connected to its drain, the midpoint of connection of the drains of the complementary transistors of the other branch being connected to the gate of a second N-channel MOS transistor connected, in said output stage, in series between the supply terminals, with a first impedance, the midpoint of the series connection of said first impedance and of the second transistor forming the output terminal of said first differential comparator.

According to an embodiment of the present invention, the second differential comparator is comprised of two symmetrical differential branches, each formed of the series connection of a second impedance and of a third N-channel MOS transistor, respectively, the sources of the third N-channel transistors being interconnected to the drain of a fourth N-channel MOS transistor having its source connected to ground, the gate of the fourth N-channel transistor being connected to the gate of the second N-channel MOS transistor of the output stage of the first differential comparator.

The foregoing objects, features and advantages of the present invention, will be discussed in detail in the following non-limiting description of specific embodiments in connection with the accompanying drawings.

BRIEF DESCRIPTION OF THE DRAWINGS

FIG. 3 shows in the form of a partial simplified block diagram a linear regulator according to an embodiment of the present invention associated with a load;

FIG. 4A is a timing diagram illustrating a first reference voltage of the regulator of FIG. 3;

FIG. 4B is a timing diagram illustrating the output voltage of the regulator of FIG. 3;

FIG. 4C is a timing diagram illustrating a second voltage reference of the regulator of FIG. 3;

FIG. 4D is a timing diagram illustrating a voltage across a component of an output stage of the regulator of FIG. 3;

DETAILED DESCRIPTION

Figure 1:
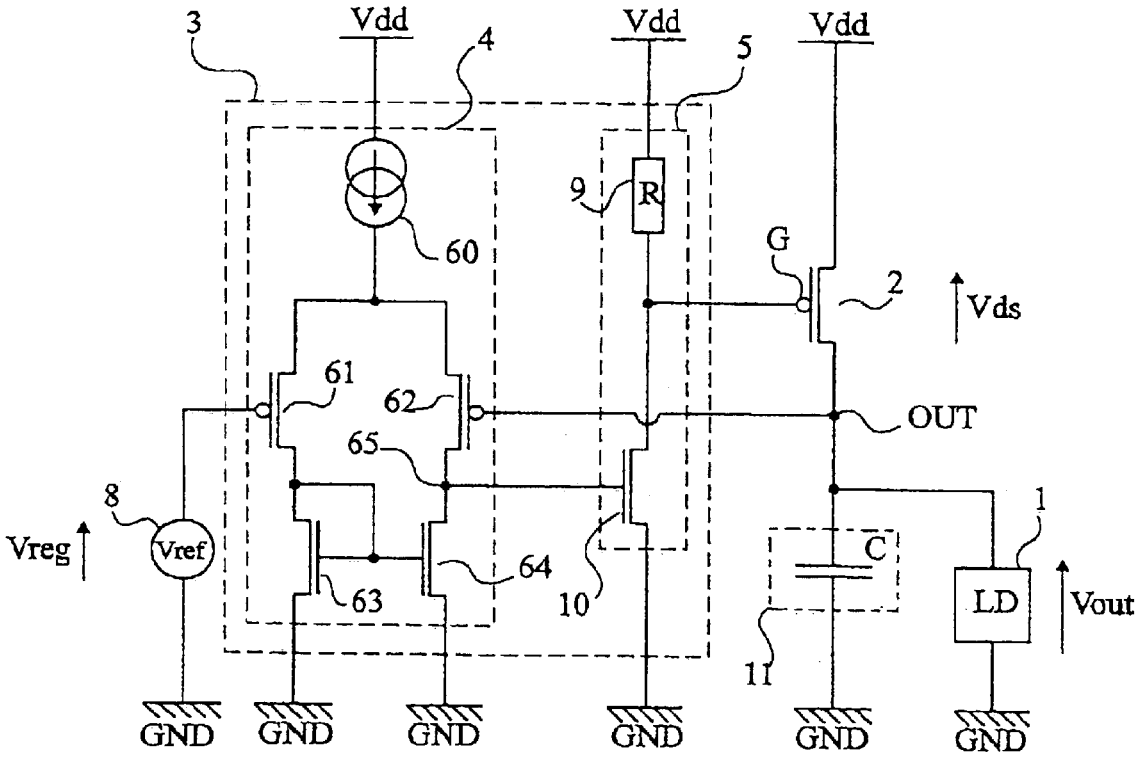
FIG. 1, previously described, partially and schematically shows the structure of a known linear regulator associated with a load.

For clarity, the same elements have been referred to with the same reference numerals in the different drawings. Further, only those elements which are necessary to the understanding of the present invention have been shown. Thus, possible validation circuits of the reference voltage generators are neither shown, nor described.

FIG. 3 shows in the form of a block diagram a linear regulator 30 according to an embodiment of the present invention. Regulator 30 comprises an output stage 31 formed of the series connection, between a high supply rail Vdd and an output terminal OUT, of two P-channel MOS transistors 32 and 33. Output terminal OUT is intended to be connected to a first supply terminal of a load (LD) I having a second supply terminal connected to a low supply rail or ground GND. To rapidly stabilize the regulated output voltage, linear regulator 30 also comprises, preferably, a stabilization impedance 11, for example, a capacitor C.

The regulation of voltage Vout across load 1, that is, on output terminal OUT, is performed by modulating control signals of gates G1 and G2 of transistors 32 and 33, respectively, to modify their transconductance.

The control signals of output stage 31 are generated by a control circuit 35. Circuit 35 modulates the control signal of gate G1 of transistor 32 to regulate the voltage at midpoint MID of the series connection of transistors 32 and 33 of output stage 31. It also modulates the control signal of gate G2 of transistor 32 to regulate output voltage Vout. Circuit 35 comprises an input/output stage (IN/OUT) 36 intended to generate the control signals and a reference stage (REF) 37. Input/output stage 36 comprises four input terminals I1, I2, I3, and I4 and two output terminals O1 and O2. Terminal I1 receives a voltage reference V1 for regulating output voltage Vout. Terminal 12 receives output voltage Vout. Terminal 13 receives a voltage reference V2 for regulating the voltage at midpoint MID. Terminal 14 receives voltage Vmid of midpoint MID by direct connection to this point. Output terminals O1 and O2 are respectively connected to gates G1, G2.

Regulation reference voltages V1 and V2 received on terminals I1 and I3 of stage 36, respectively, are provided by reference circuit (REF) 37 based on a variable D.C. voltage source 38 (Vreg). More specifically, to regulate midpoint MID to guarantee an equipartition of the voltages across each of the two transistors in series 32 and 33, regulation reference voltage V2 of midpoint MID is equal to half the sum of high supply voltage Vdd and of first regulation reference voltage V1 (V2=(Vdd+V1)/2). Source 38 thus directly provides, preferably, first reference voltage V1 (Vreg=V1), based on which circuit 37 provides second reference voltage V2 according to the preceding relation.

FIGS. 4A, 4B, 4C, and 4D respectively illustrate in timing diagrams the variation along time t of reference voltage V1 for regulating output voltage Vout of regulator 30 of circuit 3, of output voltage Vout, of reference voltage V2 for regulating the voltage of midpoint MID, and of current voltage Vmid at midpoint MID, that is, the drain voltage of transistor 32.

Figure 2A:
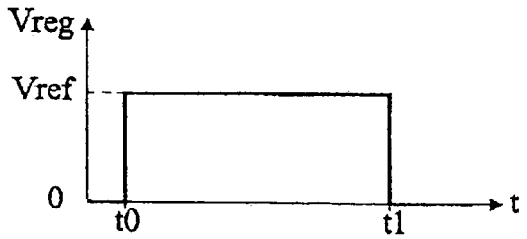
FIGS. 2A to 2C, previously described, are timing diagrams illustrating the operation of the regulator of FIG. 1.
Figure 2B:
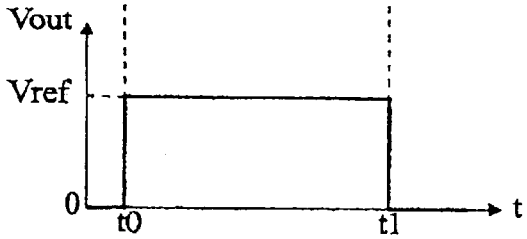
Figure 2C:
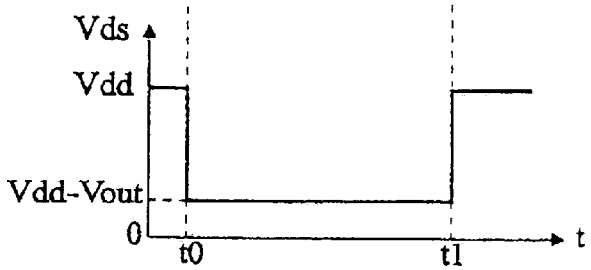

As regulator 30 is turned on, at a time t10, reference circuit 37 is validated by a turning-on of source 38 and generates regulation reference voltages V1 and V2. As illustrated in FIGS. 4A and 4C, regulation reference voltages V1 and V2 are, in a starting phase, (times t10 to t11), parallel ramps. Indeed, as indicated previously, to ensure a voltage distribution balance across transistors 32 and 33, it must be ensured that at any time the voltage at midpoint MID is equal to half the difference between high supply voltage Vdd and voltage Vout across load 1 (Vmid=(Vdd−Vout)/2). For this purpose, a reference voltage equal to half the sum of high supply voltage Vdd and of first reference voltage V1 must be applied. Upon variation of reference voltage V1 from a zero value to a nominal reference value Vref, control circuit 35 must be able to ensure such a condition. To enable linear follow-up, it is then preferable for reference voltage V1 to vary slowly rather than abruptly as in the case of a standard reference voltage (FIG. 2A).

As illustrated in FIG. 4B, in the starting phase, output voltage Vout follows, from time t10, first reference voltage V1 until it stabilizes at time t11 at nominal value Vref. Voltage Vmid at midpoint MID, illustrated in FIG. 4D, however decreases in a controlled manner from half the high supply voltage (Vdd/2) to the steady value (Vdd−Vref)/2. In nominal operation, between times t11 and t12, output voltage Vout and midpoint voltage Vmid are maintained steady by steady reference voltages V1 and V2. In a turn off control of load 1 at a time t12, to enable linear follow-up of second reference voltage V2, first reference voltage V1 is progressively brought down to zero along a ramp until a time t13. Supply Vdd then symmetrically distributes on transistors 32 and 33.

In nominal operation, (from t11 to t12), control circuit 35 ensures for any possible fluctuation of the power at the level of load 1 to translate as a variation in reference voltages V1 and V2 to restore the nominal operation and distribute the power variation symmetrically on the two power transistors 32 and 33. Thus, none of the two transistors 32 and/or 33 has to face an excessive drain/source voltage.

Power-up and power-off ramps of different respective slope have been shown in FIG. 4. More specifically, a faster power-off (t12–t13) than the power-up (t10–t11) has more particularly been shown. In practice, the slope of the ramps depends on the technical performances of the circuits and especially on the capacity of control circuit 35 to follow, transform and transmit the variation of first reference voltage V1. The slopes may be faster or slower than what is shown. Further, they may be symmetrical or exhibit an asymmetry which is the inverse of that shown, that is, the power-up may be faster than the power-off.

Figure 5:
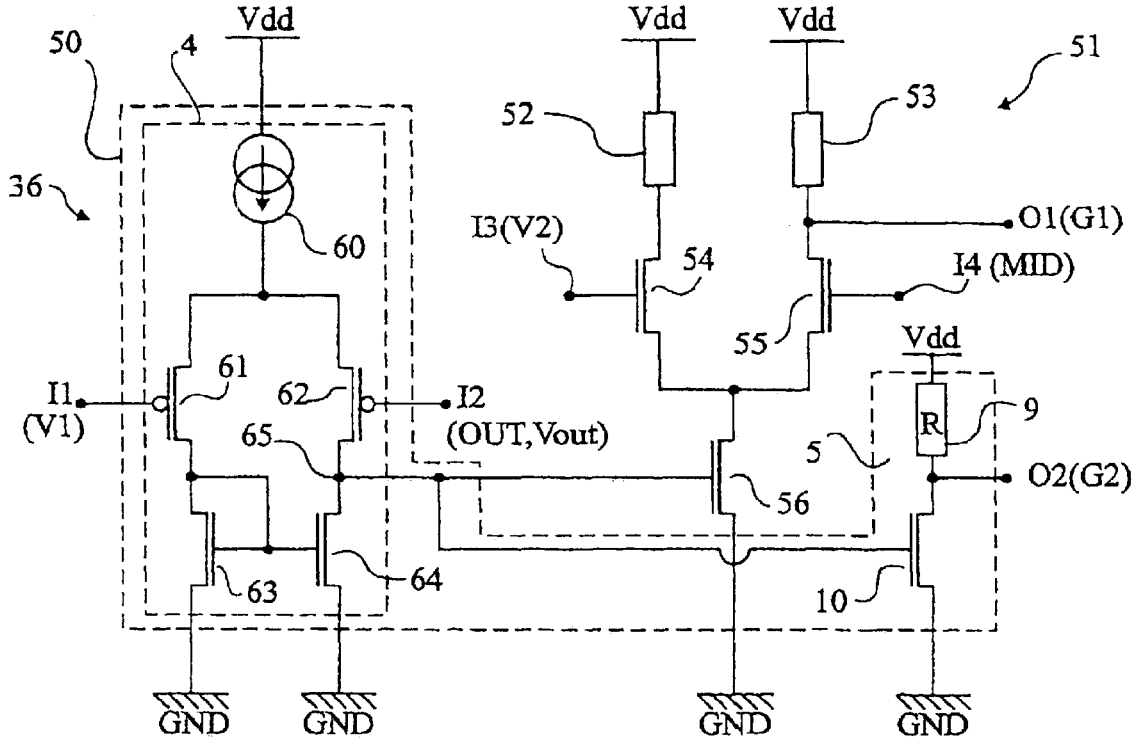
FIG. 5 partially and schematically shows an embodiment of an input/output stage of the regulator of FIG. 3.

FIG. 5 schematically and partially illustrates the structure of an embodiment of the input/output stage 36 of a control circuit 35 of an output stage 31 of a regulator 30 according to the present invention.

Input/output circuit 36 with four inputs and two outputs is a differential comparator. More specifically, circuit 36 is formed of the association of a first differential comparator 50 and of a second differential comparator 51 interlaced as follows.

First comparator 50, delimited by a frame in dotted lines in FIG. 5, is intended to regulate output voltage Vout based on first reference voltage V1. Comparator 50 thus has a structure similar to that of a known differential comparator such as comparator 3 described in relation with FIG. 1. For clarity, the structure of comparator 50 is described hereafter by means of the same reference numerals as in FIG. 1.

Comparator 50 comprises an input/output stage 4 and an output stage 5. Stage 4 comprises two differential branches, each comprised of a P-channel MOS transistor 61, 62 series connected with an N-channel MOS transistor 63, 64. The sources of transistors 61 and 62 are connected to an output terminal of a current source 60, an input terminal of which is connected to high supply Vdd. The sources of transistors 63 and 64 are connected to low supply GND. The gates of transistors 63 and 64 are interconnected. The gate of transistor 61 forms terminal I1 and receives reference voltage V1. The gate of transistor 63 is connected to its drain, that is, also to the drain of transistor 61. The gate of transistor 62 forms terminal 12 and receives current voltage Vout across load 1 by a connection to output terminal OUT of the regulator. Connection point 65 of the drains of transistors 62 and 64 forms the output of input/output stage 4 of comparator 50.

Output stage 5 is formed of the series connection, between high supply Vdd and ground GND, of an impedance 9, preferably resistive (R), and of a an N-channel MOS transistor 10. The connection point of impedance 9 and of transistor 10 forms output terminal O2 providing the control signal of gate G2 of transistor 33. The gate of transistor 10 is connected to midpoint 65 of differential branch 62-64 of input stage 4.

Second differential comparator 51 is intended to control the regulation of the voltage at point MID. It provides on output terminal 01 the control signal of gate GI. Second comparator 51 comprises two symmetrical differential branches, each formed of the series connection of an impedance 52, 53, preferably resistive, and of an N-channel MOS transistor 54, 55, respectively. The sources of transistors 54 and 55 are connected to the drain of an N-channel MOS transistor 56 having its source connected to ground GND. The gate of transistor 56 is connected to output 65 of input/output stage 4 and to the gate of transistor 10 of output stage 5 of first differential comparator 50. Accordingly, the operating point of the second differential comparator 51 depends on that of output stage 5 of first differential comparator 50. This enables stabilizing the control signal of gate G1 of transistor 32 at most at a required level, which depends on the level of the control signal of gate G2 of transistor 33 provided by first comparator 50. In particular, when load 1 is invalidated and transistor 33 is off, transistor 56 will be totally conductive and will enable a control of gate G1 capable of limiting voltage Vmid to half (Vdd/2) the high supply, as described previously in relation with FIG. 4. The gates of transistors 54 and 55 form, respectively, terminals 13 and 14 of application of voltages V2 and Vmid.

Figure 6:
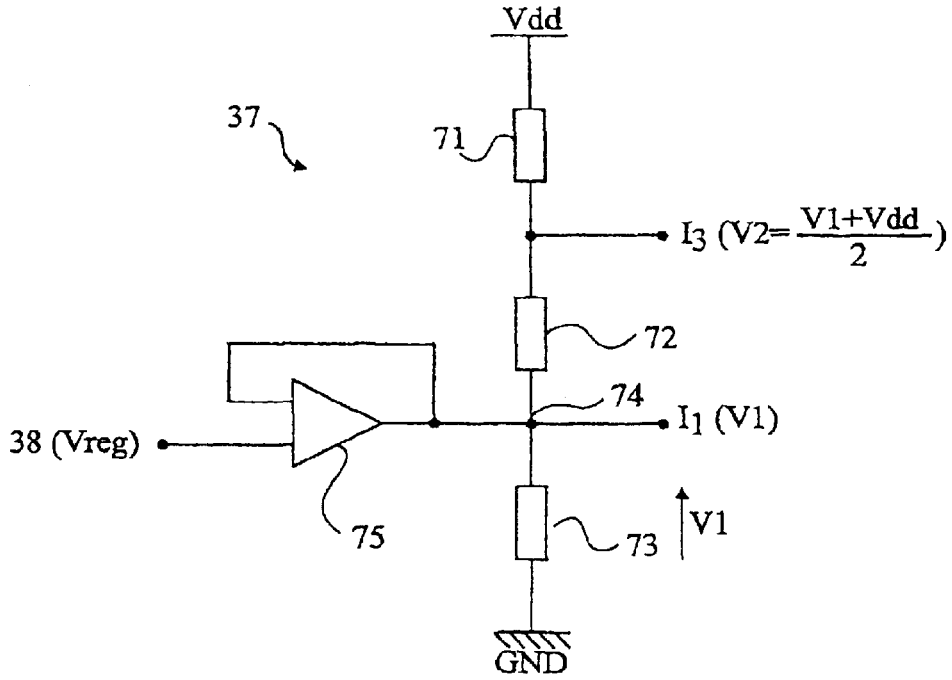
FIG. 6 shows an embodiment of a generator of first and second voltage references usable in the regulator of FIG. 3.

FIG. 6 schematically and partially shows an embodiment of a generator 37 of reference voltages V1 and V2. Reference circuit 37 is, according to an embodiment of the present invention, a resistive dividing bridge. The resistive bridge comprises the series connection between high supply rail Vdd and low supply rail GND of three successive resistors 71, 72, and 73. Connection point 74 of resistors 72 and 73 is the output terminal of a differential comparator 75 with two inputs and one output, for example, similar to comparator 3 of FIG. 1. The non-inverting input terminal of comparator 75 receives reference voltage Vreg for regulating output voltage Vout of regulator 30, for example, by a connection to source 38. The inverting input of comparator 75 is connected to output terminal 74. Thus, the first reference voltage called V1 is copied across resistor 73. By choosing resistors 71 and 72 of same values, the midpoint of these two resistors is controlled linearly by comparator 75 at the desired value V2 of half the sum of the supply voltage and of first reference voltage V1.

The present invention advantageously provides a linear power regulator that can be completely made with a standard low-voltage MOS manufacturing process and of small dimensions. Indeed, the replacing of the high-voltage MOS transistor of known regulators by two low-voltage transistors enables reducing the integration surface area. Further, the surface area increase of control part 35 with respect to the control circuit of a known regulator is negligible as compared to the gain in surface area linked to the power switch change.

Further, the linear regulator according to the present invention exhibits a waste voltage smaller than that of known regulators. As a non-limiting example, if high supply voltage Vdd is from 3.3 to 5.5 volts, each transistor 32 and 33 of output stage 31 of linear regulator 30 of the present invention is a standard MOS transistor capable of standing a drain/source voltage of approximately 2.5 volts. The waste voltage of the regulator is then reduced to values on the order of 200 mV.

Of course, the present invention is likely to have various alterations, modifications, and improvement which will readily occur to those skilled in the art. In particular, it should be noted that capacitor C (impedance 11) for stabilizing output voltage Vout has been described as functionally belonging to linear regulator 30. In practice, the capacitance of capacitor C is relatively high and varies according to the application, that is, to load 1. Capacitor C thus is, preferably, formed outside of an integrated circuit chip comprising the whole of regulator 30, and is directly assembled in parallel on load 1. Further, those skilled in the art will know how to modify the characteristics of the various components according to the used manufacturing process.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A linear regulator having an output stage comprising first and second P-channel MOS transistors serially connected between a first D.C. supply terminal and an output terminal providing a regulated output voltage, and a circuit for controlling the first and second transistors capable of providing said first and second transistors with first and second control signals as a function of the output voltage and the voltage at the midpoint of the series connection.

2. The regulator of claim 1, wherein the control circuit comprises an input/output circuit and a reference circuit, the input/output circuit comprising:

a first input, receiving a first voltage reference provided by said reference circuit;

a second input, connected to said output terminal;

a third input receiving a second voltage reference provided by said reference circuit;

a fourth input connected to said midpoint;

a first output connected to the gate of the first transistor; and a second output connected to the gate of the second transistor.

3. The method of claim 2, wherein the input/output circuit is a double differential comparator with four inputs and two outputs.

4. The regulator of claim 2, wherein the input/output circuit comprises first and second differential comparators with two inputs and two outputs, the input terminals of the first differential comparator being the first and second input terminals of the input/output circuit and its output being the second output of said input/output circuit; and the input terminals of the second differential comparator being the third and fourth input terminals of said input/output circuit and its output being the first output thereof.

5. The regulator of claim 4, wherein the first differential comparator comprises an input/output stage and an output stage, said input output stage comprising two differential branches, each of which comprises a P-channel MOS transistor connected in series with a first N-channel MOS transistor, the sources of the P-channel transistors being interconnected to an output terminal of a current source having an input terminal connected to said D.C. supply terminal, the sources of the first N-channel transistors being interconnected to a ground terminal, the gates of the N-channel MOS transistors being interconnected, the gates of the P-channel transistors forming the first and second input terminals of the input/output circuit, the gate of said first N-channel MOS transistor of the branch comprising the first input being connected to its drain, the midpoint of connection of the drains of the complementary transistors of the other branch being connected to the gate of a second N-channel MOS transistor connected, in said output stage, in series between the supply terminals, with a first impedance, the midpoint of the series connection of said first impedance and of the second transistor forming the output terminal of said first differential comparator.

6. The regulator of claim 5, wherein the second differential comparator is comprised of two symmetrical differential branches, each formed of the series connection of a second impedance and of a third N-channel MOS transistor, respectively, the sources of the third N-channel transistors being interconnected to the drain of a fourth N-channel MOS transistor having its source connected to ground, the gate of the fourth N-channel transistor being connected to the gate of the second N-channel MOS transistor of the output stage of the first differential comparator.

7. A linear regulator having an output stage comprising first and second P-channel MOS transistors serially connected between a first terminal and an output terminal to provide a regulated output voltage, and a circuit that controls the first and second transistors capable of providing said first and second transistors with first and second control signals as a function of the output voltage and the voltage at the midpoint of the series connection.

8. The regulator of claim 7, wherein the control circuit comprises an input/output circuit and a reference circuit, the input/output circuit comprising:

a first input, receiving a first voltage reference provided by said reference circuit;

a second input, connected to said output terminal;

a third input receiving a second voltage reference provided by said reference circuit;

a fourth input connected to said midpoint;

a first output connected to the gate of the first transistor; and a second output connected to the gate of the second transistor.

9. The method of claim 8, wherein the input/output circuit is a double differential comparator with four inputs and two outputs.

10. The regulator of claim 8, wherein the input/output circuit comprises first and second differential comparators with two inputs and two outputs, the input terminals of the first differential comparator being the first and second input terminals of the input/output circuit and its output being the second output of said input/output circuit; and the input terminals of the second differential comparator being the third and fourth input terminals of said input/output circuit and its output being the first output thereof.

11. The regulator of claim 10, wherein the first differential comparator comprises an input/output stage and an output stage, said input output stage comprising two differential branches, each of which comprises a P-channel MOS transistor connected in series with a first N-channel MOS transistor, the sources of the P-channel transistors being interconnected to an output terminal of a current source having an input terminal connected to said first terminal, the sources of the first N-channel transistors being interconnected to a ground terminal, the gates of the N-channel MOS transistors being interconnected, the gates of the P-channel transistors forming the first and second input terminals of the input/output circuit, the gate of said first N-channel MOS transistor of the branch comprising the first input being connected to its drain, the midpoint of connection of the drains of the complementary transistors of the other branch being connected to the gate of a second N-channel MOS transistor connected, in said output stage, in series between the supply terminals, with a first impedance, the midpoint of the series connection of said first impedance and of the second transistor forming the output terminal of said first differential comparator.

12. The regulator of claim 11, wherein the second differential comparator is comprised of two symmetrical differential branches, each formed of the series connection of a second impedance and of a third N-channel MOS transistor, respectively, the sources of the third N-channel transistors being interconnected to the drain of a fourth N-channel MOS transistor having its source connected to ground, the gate of the fourth N-channel transistor being connected to the gate of the second N-channel MOS transistor of the output stage of the first differential comparator.

* * * * *

UNITED STATES PATENT AND TRADEMARK OFFICE

CERTIFICATE OF CORRECTION

PATENT NO. : 6,894,467 B2
DATED : May 17, 2005
INVENTOR(S) : Alexandre Pons et al.

It is certified that error appears in the above-identified patent and that said Letters Patent is hereby corrected as shown below:

Column 6,
Line 51, should read -- forms terminal 12 and receives current voltage Vout across --.
Line 66, should read -- output terminal O1 the control signal of gate G1. Second --.

Column 7,
Line 19, should read -- minals 13 and 14 of application of voltages V2 and Vmid. --.

Signed and Sealed this

Twenty-seventh Day of September, 2005

JON W. DUDAS
*Director of the United States Patent and Trademark Office*